United States Patent [19]

Victor et al.

[11] 3,989,240

[45] Nov. 2, 1976

[54] ELECTRICALLY TIMED EXERCISING DEVICE

[76] Inventors: Bernard J. Victor, 122 Park Place, Pittsburgh, Pa. 15237; Kenneth M. Tudoverto, 94 N. Euclid Ave., Pittsburgh, Pa. 15202; Bernard J. Victor, Jr., 122 Park Place, Pittsburgh, Pa. 15237

[22] Filed: May 6, 1975

[21] Appl. No.: 575,088

[52] U.S. Cl. ..... 272/125; 235/151; 128/25 R; 273/134

[51] Int. Cl.[2] ..... A63B 21/24

[58] Field of Search ..... 272/79 R, DIG. 4, DIG. 5, 272/83 A, 80, 58, 129, 134, 125, 79 A, 83; 128/25 R, 63; 340/172.5; 235/151

[56] References Cited

UNITED STATES PATENTS

| | | | |
|---|---|---|---|
| 857,447 | 6/1907 | Cooper | 272/81 |
| 3,372,928 | 3/1968 | Showalter | 272/79 R X |
| 3,387,493 | 6/1968 | Strittmatter | 272/79 R X |
| 3,822,061 | 7/1974 | Sigma | 272/DIG. 5 X |
| 3,848,467 | 11/1974 | Flavell | 272/79 R X |

*Primary Examiner*—Richard C. Pinkham
*Assistant Examiner*—William R. Browne
*Attorney, Agent, or Firm*—Buell, Blenko & Ziesenheim

[57] ABSTRACT

A power exerciser having a frame, variable power motor, strap, strap grips and sequencing control. The motor causes horizontal pull and vertical lift body movements through use of the straps. The duration and extent of each movement can be controlled by electro-mechanical sequencing. The sequencing control is connected to the power motor for providing a preselected time sequence of instructions to the power motor for limiting the lengths of extension and retraction of the straps. A unit is provided for presetting the sequencing control the power motor during an exercise program.

5 Claims, 5 Drawing Figures

BODY

ARM

HYPER

ELBOW SHOULDER

KNEE HIP

HIP BODY

ELECTRICALLY TIMED EXERCISING DEVICE

This invention relates to a power exerciser and particularly to an exerciser useful for both active physical exercise and passive body movement during physiotherapy. The power exerciser of the present invention permits an unlimited range of body movements which can be performed either actively or totally passively employing the power sequence motor of the exerciser. The power exerciser of the present invention can be manually controlled or programmed for automatic control. The extent of motion and duration of each exercise can be varied by means of electro-mechanical sequencing. The power exerciser can also be controlled by a hand transmitter remote from the machine.

Various forms of power exercisers are old in the art. These exercisers generally permit only a limited range of body movements and require that persons using them relinquish all control over the operation of the machine. None of the exercisers in the prior art permit the infinite variety of both horizontal pull and vertical lift body movements made possible by the invention of the present application.

The present invention provides a novel and significant improvement over presently available power exercisers. The invention provides a valuable tool for maintaining one's good physical condition or for rehabilitating damaged or deteriorated muscles by physiotherapy. In a preferred form of our invention we provide a reversible drive electric motor which is activated by a series of on-off switches which can be controlled by either the person using the exerciser or an attendant supervising the use of the exerciser. The motor is used to rotate a shaft and pulley arrangement which causes the extension and retraction of a pair of nylon straps which are fixed by means of a pulley to a shaft rotated by the drive motor. The length of strap extension or retraction is incrementally controlled by means of the on-off switches. By increasing the number of switches which are in the on condition a larger amount of strap will be extended and extension will be continued until a switch in the off condition is reached to cause the drive motor to reverse and retract the straps. The on-off condition of these switches can be controlled by means of a selector switch mounted on a control counsel or by remote transmitter. Also, the number of repetitions of the cycle of the motor operation can be controlled by means of a counter electrically connected to the motor.

In the foregoing general description, we have set out certain purposes, objects and advantages of our invention. It will be described hereafter and will become apparent for those skilled in the art of the construction and use of power exercisers when considering the following descriptions and drawings in which:

FIG. 1 is an isometric view of the power exerciser of this invention;

FIGS. 2A to 2F inclusive, are diagrammatic views of six exercises which can be performed with the power exerciser of the present invention;

Figure 1:
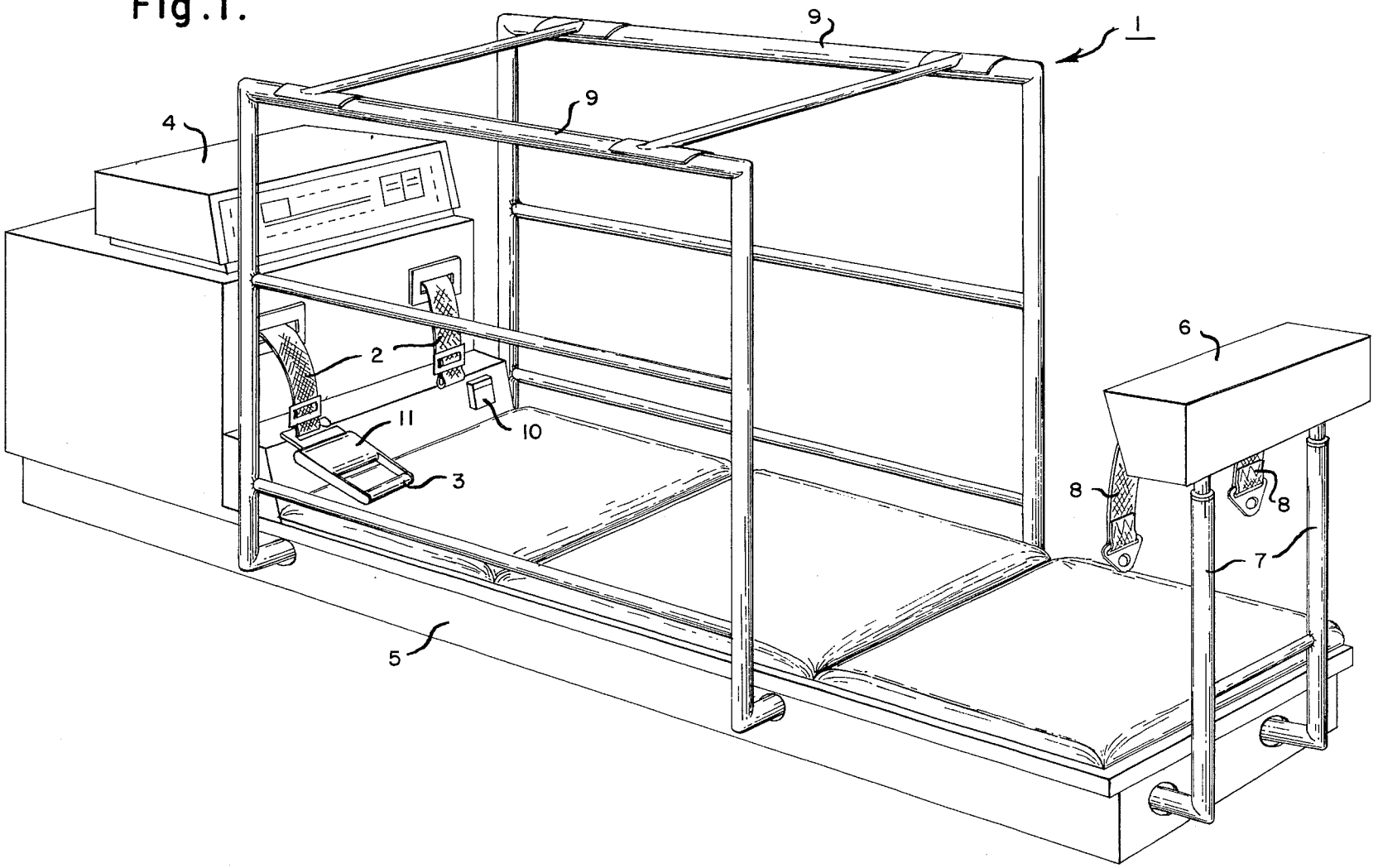
Figure 2A:
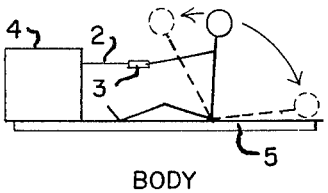
Figure 2B:
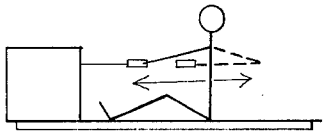
Figure 2C:
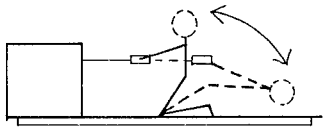
Figure 2D:
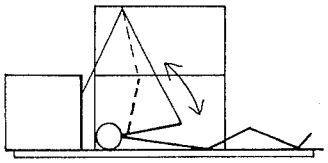
Figure 2E:
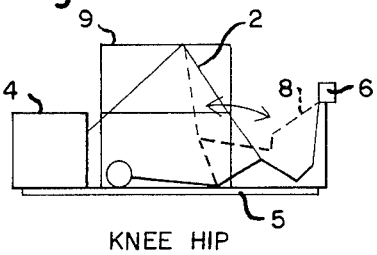
Figure 2F:
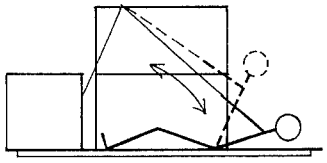

Referring to the drawings, we have illustrated in FIG. 1, a power exerciser 1 having straps 2 strap handles 3, only one shown, console 4 frame 5. Strap tension means 6 has supports 7 which are attached by well-known means to frame 5 by well-known means. Belts 8 of tension means 6 are assisting belts for various exercises as shown in FIG. 2E. Auxiliary bars 9 for performing various exercises are also attached to frame 5 by well-known means. Foot control 10, enables the person using the exerciser to turn it on and off at any point in the time during use. One of the handles 3 contains a radio controlled start/stop transmitter 11 (FIG. 3) and the other handle, not illustrated, contains a radio transmitter 12 for reversing the motor of the power exerciser. Controls 11 and 12 enable the person using the machine to either start or stop it or reverse the direction of the travel of the straps.

Figure 3:
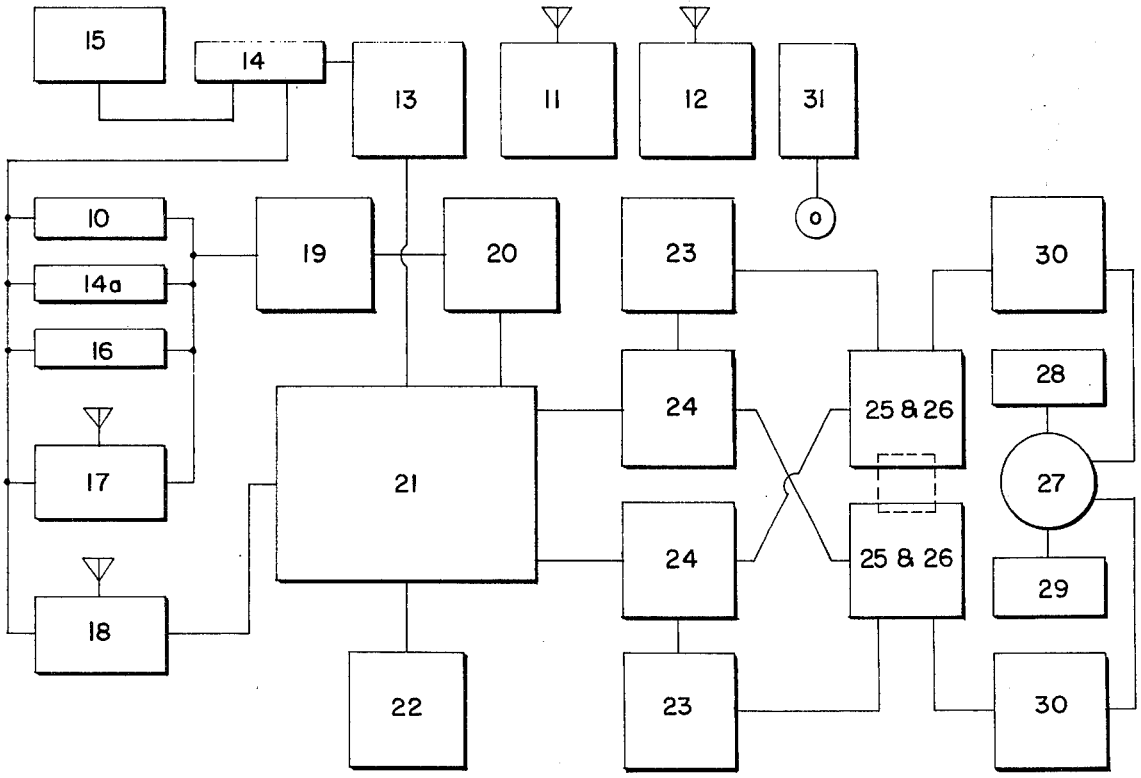
FIG. 3 is a block diagram of the electrical circuitry of the present invention.

Referring to FIG. 3 the power exerciser of the present invention includes an electro-magnetic predetermining and totalizer counter 13 which can be mounted on the face of control console 4. Mounted on the face of control console 4 and operably connected to counter 13 is a predetermining counter switch 14 and a console mounted to shut off switch 14a. A master control on/-off switch 15 and a remote on/off switch 16 can also be conveniently mounted on control console 4.

The control elements of the power exerciser include a radio activated on/off switch 17 radio activated sequencing switch 18 on/off relay 19 and power relay 20 and electromechanical sequencer 21. Sequencer 21 is more fully shown in FIG. 5. A manual stop switch 22 is operably connected to sequencer 21. Time delay relays 23 and sequence relays 24 are operably connected to latching motor 25 and sequence control relay 26. The 110/60/1 power drive variable speed electric motor 27 has motor brake 28 and variable speed control 29 and motor contacts 30. The electric motor can be turned on/off or its direction reversed by means of the radio controls 11 and 12 located in strap handles 3 by master on/off switch 15, foot control on/off switch 10 or by means of a remote radio control 31. The controls, the circuitry and its operation are well-known and understood to any one of skill in the art.

Figure 4:
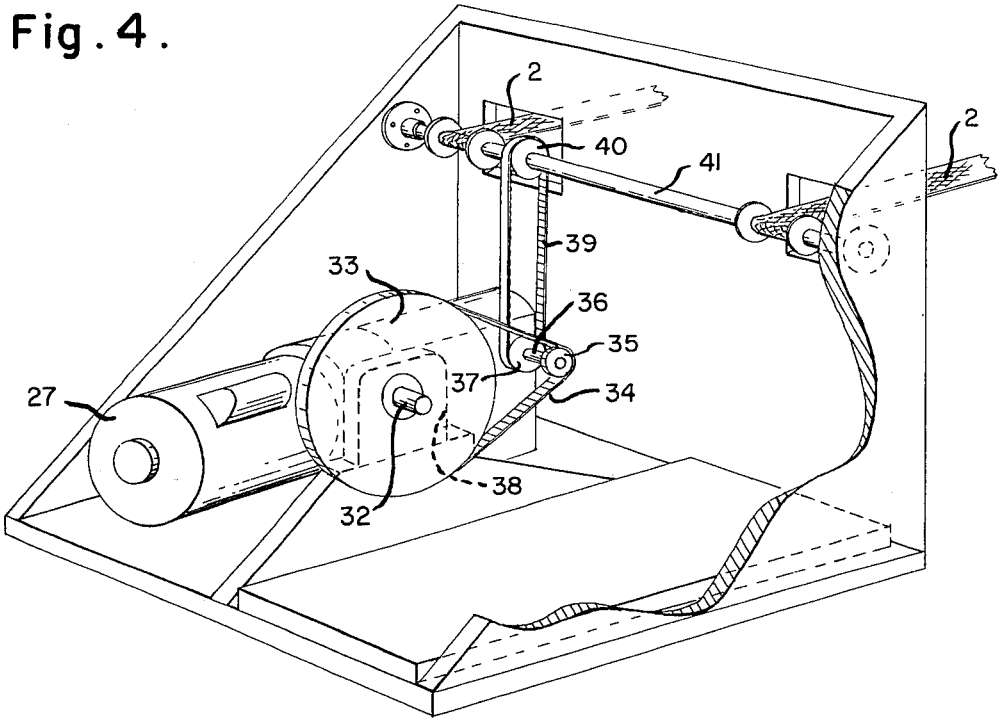
FIG. 4 is a perspective view partially cut away showing the drive means of the present invention.
Figure 5:
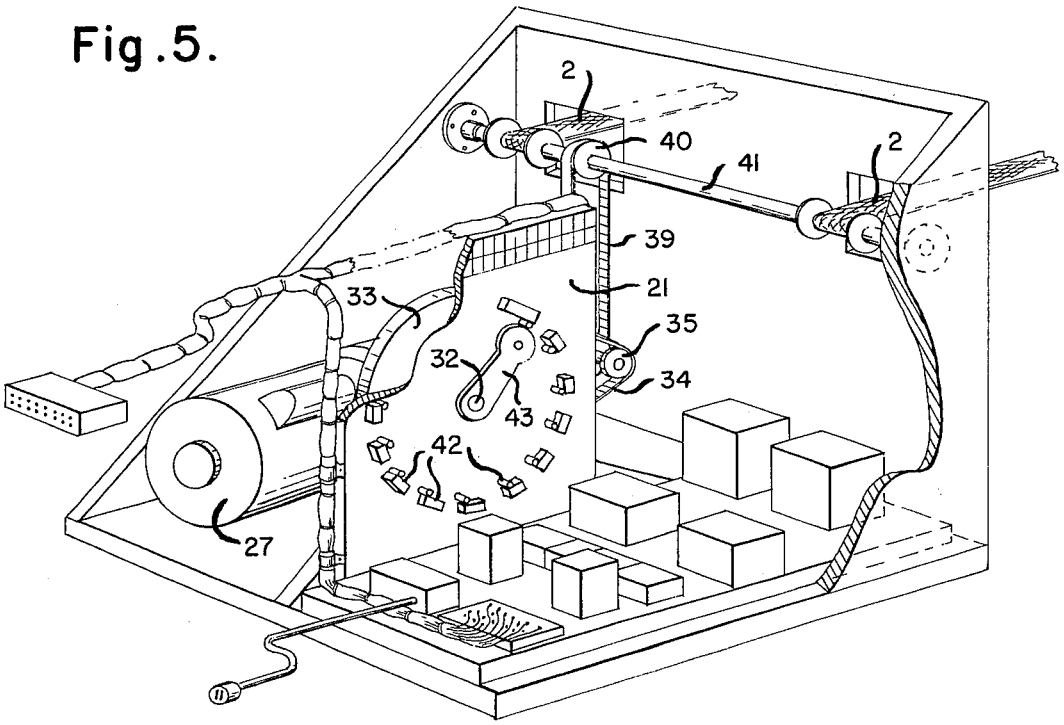
FIG. 5 is a perspective view similar to FIG. 4 with the addition of the power sequencing switches and the electrical circuitry of the present invention.

FIGS. 4 and 5 show the electric motor 27 and the sequencing mechanism 21 of the present invention. Electric motor 27 is a 110/60/1 power drive variable speed electric motor. Motor 27 drives shaft 36 to which is attached pulley 35. Pulley 35 drives belt 34 which is in turn attached to pulley 33 which is mounted on shaft 32 which extends through pulley 33. Shaft 32 is notably mounted to support 38.

Shaft 36 also carries a pulley 37 which has a belt 39 which drives pulley 40 which is fixed to shaft 41 which is rotatably mounted within console 4 by means well-known in the art. Belts 2 are fixably attached to shaft 41. By energizing motor 27 the straps can be extended and then be retracted by reversing the motor.

Sequencing mechanism 21 is comprised of a plurality of on/off switches 42. Switch actuating arm 43 is mounted on shaft 32. Each of switches 42 can be turned on/off by a series of switches mounted on console 4, not shown. In operation the motor will remain on in a forward position and thereby extending straps 2 until actuating arm 43 reaches a switch 42 in the off position. Motor 27 then automatically reverses itself and fully retracts straps 2. In the event that the person using machine wishes to reverse the motor and cause strap retract prior to the full extension provided for, he can automatically reverse the motor by means of the control features described above such as handle housed radio control 12.

Referring to FIGS. 2A through 2F, some of the various exercises made possible by the exerciser of the present invention are shown. The body exercise shown would be accomplished by the person using the machine sitting on frame 5 in an upright position and grasping handle 3. The machine would be turned on and the straps extended until the person would be able to lie down on frame 5. By reversing the motor, the straps would then be retracted causing the person to again sit in the upright position. Such exercises are invaluable in physiotherapy and the like.

When the invention is in remotely controlled a totally passive person could be made to grip the bars and the exercise repeated the number of times desired and the machine stopped or reversed at any time by means of remote control 31. Also, the number of repetitions for a particular exercise can be controlled by means of counters 14 and the machine made to shut off automatically when the desired number is reached by switch 14.

In the foregoing specification we have set out certain preferred embodiments of our invention, however, it will be understood that this invention may be otherwise embodied within the scope of the following claims.

We claim:

1. A power exerciser comprising:

a. a frame, b. power means for supplying mechanical power fixably attached to said frame, c. a plurality of straps operably attached to said power means, said straps being extendable or retractable by said power means, d. means for activating and deactivating said power means, e. sequencing means operably connected to said power means for providing a preselected timed sequence of instructions to the power means for limiting the lengths of extension and retraction of said straps while a user is attached to the free ends thereof; and f. said sequencing means including selector means operably connected thereto for presetting said sequencing means to control said power means during an exercise program in which a user is acted upon by the exerciser.

2. The power exerciser of claim 1 wherein said power means and said activating and deactivating means is operable by means of radio transmitter attached to said straps.

3. The power exerciser of claim 1 where said power means and said activating and deactivating means is operable by remote radio transmitter.

4. The power exerciser of claim 1 having support means for positioning and tensioning said straps.

5. The power exerciser of claim 1 having electric counter means for registering the number of extension and retractions of said straps, said counter means being connected to said power means to deactivate said power means after a preset number of repetitions are recorded by said counter means.

* * * * *